US009914566B2

(12) United States Patent
Chevalier

(10) Patent No.: US 9,914,566 B2
(45) Date of Patent: Mar. 13, 2018

(54) CLOSURE CAP FOR A PRODUCT CONTAINER, IN PARTICULAR A COSMETIC PRODUCT CONTAINER

(71) Applicant: L V M H Recherche, Saint Jean de Braye (FR)

(72) Inventor: Marc Chevalier, Franconville (FR)

(73) Assignee: L V M H RECHERCHE, Saint Jean de Braye (FR)

( * ) Notice: Subject to any disclaimer, the term of this patent is extended or adjusted under 35 U.S.C. 154(b) by 0 days.

(21) Appl. No.: 14/351,751

(22) PCT Filed: Oct. 26, 2012

(86) PCT No.: PCT/FR2012/052477

§ 371 (c)(1),
(2) Date: Apr. 14, 2014

(87) PCT Pub. No.: WO2013/061003

PCT Pub. Date: May 2, 2013

(65) Prior Publication Data

US 2014/0299600 A1 Oct. 9, 2014

(30) Foreign Application Priority Data

Oct. 27, 2011 (FR) ..... 11 59785
Oct. 27, 2011 (FR) ..... 11 59787

(51) Int. Cl.
*B65D 43/12* (2006.01)
*B65D 43/20* (2006.01)
(Continued)

(52) U.S. Cl.
CPC ..... *B65D 41/04* (2013.01); *A45D 34/00* (2013.01); *A45D 40/222* (2013.01);
(Continued)

(58) Field of Classification Search
CPC ..... B65D 47/26; B65D 47/265; B65D 47/28; B65D 47/285; B65D 2251/01
(Continued)

(56) References Cited

U.S. PATENT DOCUMENTS 1,852,198 A 4/1932 Bemis
3,055,041 A 9/1962 Schaich
(Continued)

FOREIGN PATENT DOCUMENTS

CH 264797 A 12/1948
DE 8706417 U1 5/1987
(Continued)

OTHER PUBLICATIONS

Search report for related French Application No. 11 59787; report dated Dec. 20, 2011.
(Continued)

*Primary Examiner* — Andrew T Kirsch
(74) *Attorney, Agent, or Firm* — Miller, Matthias & Hull LLP

(57) ABSTRACT

A closure capsule comprising a base for fitting on an opening of a container, having an upper surface provided with a dispensing orifice; a cover comprising a device for closing off said dispensing orifice, said cover being able to move with respect to the base between a closed position and an open position in which said closing-off device frees said dispensing orifice, said closing-off device comprising a rolling element arranged so as to rotate in the cover and designed to close off the dispensing orifice when the cover is in the closed position and to roll on the upper surface of the base when said cover is moved between its open and closed positions.

19 Claims, 12 Drawing Sheets

(51) Int. Cl.

| | |
|---|---|
| ***B65D 51/16*** | (2006.01) |
| ***B65D 47/26*** | (2006.01) |
| ***B65D 47/28*** | (2006.01) |
| ***B65D 41/04*** | (2006.01) |
| ***A45D 34/00*** | (2006.01) |
| ***A45D 40/22*** | (2006.01) |

(52) U.S. Cl.
CPC ..... *B65D 47/265* (2013.01); *B65D 47/268* (2013.01); *B65D 47/286* (2013.01); *A45D 2040/225* (2013.01)

(58) Field of Classification Search
USPC ..... 220/345.1, 345.3, 345.6, 351; 215/312
See application file for complete search history.

(56) References Cited

U.S. PATENT DOCUMENTS

| | | | | |
|---|---|---|---|---|
| 4,432,760 | A * | 2/1984 | Mittleman et al. | 604/246 |
| 5,785,213 | A * | 7/1998 | Guillot | 222/553 |
| 2004/0050848 | A1 | 3/2004 | Matsumoto | |
| 2011/0132926 | A1 | 6/2011 | Feierabend et al. | |

FOREIGN PATENT DOCUMENTS

| | | | |
|---|---|---|---|
| EP | 0461060 | A1 | 12/1991 |
| EP | 1614635 | A1 | 1/2006 |
| FR | 975595 | | 3/1951 |
| JP | H-02111646 | U | 9/1990 |

OTHER PUBLICATIONS

Sear report for related French Application No. 1159785; report dated Mar. 20, 2012.

International Search report and Written Opinion for the article for International Application PCT/FR2012/052477; report dated Feb. 21, 2013.

* cited by examiner

CLOSURE CAP FOR A PRODUCT CONTAINER, IN PARTICULAR A COSMETIC PRODUCT CONTAINER

CROSS-REFERENCE TO RELATED APPLICATIONS

This application is a 35 USC § 371 U.S. national stage filing of International Patent Application No. PCT/FR2012/052477 filed on Oct. 26, 2012, and claims priority under the Paris Convention to French Patent Application No. FR 11 59785 filed on Oct. 27, 2011 and French Patent Application No. FR 11 59787 filed on Oct. 27, 2011.

FIELD OF THE DISCLOSURE

The present invention relates to a closure cap for a container for a more or less viscous liquid product, especially a cosmetic product such as a liquid product for the body, face and/or hair.

More particularly, the invention relates to a closure cap for a product container, comprising:

- a base defining a central axis, adapted for attachment at an opening of a container and having an upper surface provided with a product dispensing orifice;
- a cover comprising a blocking device for closing off said dispensing orifice, and movable relative to the base between a closed position where said blocking device closes off the dispensing orifice and an open position where said blocking device frees said dispensing orifice to allow the product contained in the container to emerge.

BACKGROUND OF THE DISCLOSURE

Document FR2872491 discloses an example of such a closure cap in which the cover is connected in the conventional manner to the base by means of a film hinge or a bridge of material, so as to be pivotable between a closed position where said cover covers the upper surface of the base provided with a product dispensing orifice, and an open position where it is at a distance from the base and leaves the product dispensing orifice unobstructed.

In that document, when the cover is in the closed position relative to the base, the product dispensing orifice is sealed shut by a hollow pin projecting from the inner surface of the cover, designed to be positioned facing the upper surface of the base and entering into said orifice. In this position, the product contained in the container is brought into contact with the hollow pin and fills its inside space. When the cover is pivoted relative to the base to its open position, the inner face of the cover is visible and reveals the sealing pin filled with product, which gives the user a negative impression of the cap, especially in terms of cleanliness.

Furthermore, when the cover is in the open position, the upper surface of the base forms a product distribution surface to be touched by a user, for example with a finger, to obtain product leaving the container. Because of this, product residue can accumulate on the upper surface of the base, particularly after several uses of a container fitted with such a closure cap. When the cover is returned to the closed position relative to the base, this residue can adhere to and contaminate the inner surface of the cover, which is visible to the user when the cover is in the open position, contributing to a negative impression concerning cap cleanliness.

Lastly, in the cap according to document FR2872491, the existing sealing forces between the hollow pin and the product dispensing orifice resist the forces necessary to open and close the cover. When the user wishes to move the cover from its closed position to its open position, imparting a pivoting movement of the cover relative to the base, she has to overcome the frictional forces existing between the walls of the hollow pin and the dispensing orifice in order to withdraw said pin from said orifice and freely continue the opening movement of the cap. Similarly, when the cover is returned to its closed position, the user rotates the cover freely relative to the base, and as the hollow pin enters the dispensing orifice the user must overcome said frictional forces in order to close the cap.

This results in an impression of jerky or uneven opening and closing movements which are displeasing to the user, with a risk of spattering the product remaining on the upper face of the base and/or on the inside of the cover during these jerky movements.

This is why the sealing forces required for dependable closure of the dispensing orifice in such a design interfere with the usability and/or comfort of opening and closing the cap.

In addition, the dimensions of the hollow pin and dispensing orifice must be adapted so that the force necessary to open/close the cap is small enough to allow easy cap manipulations while being sufficiently high to reduce the risk of accidentally opening the cap, and so that the sealing force is high enough to prevent the product from escaping through the dispensing orifice when the cover is in the closed position. Thus, in the case of a pin and an orifice with complementary circular cross-sections, the diameter of said pin and said orifice must exceed a minimum value, for example on the order of 4 mm. The flow through an orifice having such a minimum diameter can give the impression of an imprecise or coarse distribution of product through the orifice.

SUMMARY OF THE DISCLOSURE

The present invention is intended to overcome these disadvantages.

In the invention, a closure cap for a product container of the aforementioned type is characterized in that the blocking device comprises a rolling element arranged so as to rotate within a housing provided in the cover and adapted to close off the product dispensing orifice when the cover is in the closed position and to roll on the upper surface of the base when the cover is moved between its open and closed positions.

Through these arrangements, the main contact between the cover and the base when opening/closing the cap is a rolling contact, which facilitates use when opening/closing the cap according to the invention.

Furthermore, as the rolling element is intended to roll on the upper surface of the base, the movement of the cover relative to the base occurs substantially parallel to the plane defined by this upper surface. Thus, the force required to open the cap is oriented in a direction substantially perpendicular to the central axis of the base, as well as to the axis of the product dispensing orifice, and the sealing force of the cap according to the invention, supported by the axis defined by the orifice, does not oppose this opening force. In other words, in the cap according to the invention, the sealing performance has little or no impact on the ease of use when opening/closing the cap.

Lastly, in the closure cap according to the invention, the elements likely to come in contact with the product or product residue, such as the underside of the cover and the rolling element of the blocking device, are not directly visible to the user when the cover is in the open position, which improves the general perception of cap quality and cleanliness.

Moreover, the path of the cover between its open and closed positions can advantageously be defined so that these elements likely to come in contact with the product or product residue remain more or less completely facing the upper face of the base and are not exposed and visible to the user when the cover is in the open position.

In preferred embodiments of the invention, one or more of the following arrangements may be used:

- The bottom of the housing in the cover has a product discharge orifice which opens into an inner space inside said cover. The product coming in contact with and adhering to the rolling element when the latter is in the position that closes off the opening can be removed from inside the inner space of the cover by the rolling effect of the rolling element when the cover is moved between its open and closed positions, to prevent fouling on said rolling element which could impact the user experience when opening/closing the cap.
- The blocking device comprises an elastic element adapted so that the rolling element exerts a biasing force on the upper surface of the base. The biasing force generated by the elastic element increases the sealing force existing between the rolling element and the dispensing orifice when the cover is in the closed position, and maintains this rolling element in contact with the upper surface of the base when said cover is in and is moved between its open and closed positions.
- The elastic element is a coating of elastic material provided at least on the surface of the rolling element in contact with the upper surface of the base, or the rolling element made entirely of this elastic material, and/or an elastic member arranged between the bottom of the housing and the rolling element.
- The rolling element has the general shape of a ball or a cylinder, the dispensing orifice of the base having a seat with a surface of complementary shape that faces said element.
- The product dispensing orifice is off-centered relative to the central axis of the base. This offset is adapted so that the opening is located in a substantially central area of the product distribution surface defined by the portion of the upper surface of the base that is exposed or uncovered when the cover is in the open position.
- In the closed position, the cover covers substantially the entire upper surface of the base, the side walls of said cover and of said base being substantially flush over at least the major portion of the circumference of the cap. This improves the visual appearance and aesthetics of the cap, as the cap presents a smooth edge when the cover is in the closed position.

In a first variant of the invention, the cover is movable relative to the base between its open and closed positions in a substantially radial guiding direction, guiding the cover relative to the central axis of the base by means of a guiding device.

In preferred embodiments of the invention according to the first variant, it may optionally further provide one or more of the following:

- said guiding device comprises a slide system extending in the guiding direction and formed by at least one rail provided on one among the cover and the base and adapted to cooperate with at least one complementary groove provided in the other among the cover and the base;
- the slide system comprises at least two rails protruding from a lower surface of the cover, facing the upper surface of the base and provided with snap-in tabs adapted to cooperate with stop surfaces defined in respective guide grooves provided in the base in order to retain said rails within said grooves;
- the snap-in tabs of the rails cooperate with stop surfaces of the grooves to retain said rails within said grooves in a direction substantially perpendicular to the guiding direction;
- the snap-in tabs of the rails cooperate with stop surfaces of the grooves to retain said rails within said grooves substantially along the guiding direction when the cover is in the open position relative to the base;
- the guiding device further comprises a device limiting the tilt of the cover relative to the base, said device comprising at least two opposite snap-in tabs projecting from one among the cover and the base and adapted to cooperate with each of the edges of a groove provided in the other among the cover and the base;
- the upper surface of the base is domed, so that at least one among the opening and closing movements of the cover can be assisted by the curvature of the upper face of the base.

In an advantageous arrangement, the closure cap according to the first variant of the invention further comprises a sound generating device designed to indicate the arrival of the cover in the closed and/or open position relative to the base, said device being formed by at least one elastic tab provided on one among the cover and the base and adapted to pass beyond at least one rigid tab provided on the other among the cover and the base when the cover reaches the closed and/or open position relative to the base. Thus, as the sound generating device is separate from the device that closes off the dispensing orifice, there is a possibility for calibrating and adjusting the opening and/or closing sound of the cap independently of the means used to seal the dispensing orifice. Furthermore, with such arrangements, the arrival of the cover in the closed position can be indicated by a sound that is different from the one that indicates the arrival in the open position, for example by sizing the associated tabs differently.

According to another advantageous embodiment, the closure cap according to the first variant of the invention further comprises a device for defining stable positions, adapted to stabilize the cover relative to the base when the cover is in the closed and/or open position, said device being formed by the rolling element of the cover cooperating with the product dispensing orifice of the base in order to stabilize said cover relative to said base when it is in the closed position, and cooperating with a complementary hollow provided in the upper surface of the base in order to stabilize said cover relative to said base when it is in the open position.

In a preferred embodiment of the first variant of the invention, at least one sliding pad is provided on one among the cover and the base, said pad being adapted to slide over the other among the cover and the base when said cover is moved between its open and closed positions. The main contact that exists between the cover and the base during the movements of opening and closing the cap is then provided by the rolling element which rolls on the base and by this or these pad. By appropriately positioning or sizing the sliding pad, the force required to open/close the cap can be fine-tuned and thus the desired ease of use can be defined.

In a second variant of the invention, the cover is rotatable relative to the base, about a pivot axis, by means of a hinge device.

In preferred embodiments of the invention according to this second variant, one or more of the following arrangements may be used:

- the hinge device comprises a sleeve integral with one among the base and the cover and mounted to rotate about the pivot axis on a pivot pin integral with the other among the base and the cover;
- the hinge device comprises at least one elastic tab integral with one among the base and the cover, said elastic tab being adapted to exert a biasing force along the pivot axis on the other among the base and the cover over at least a portion of the path the cover travels between its open and closed positions. Advantageously, said at least one elastic tab is adapted to exert a biasing force along the pivot axis over the entire path of the cover between its open and closed positions. Such an arrangement allows correcting for any gaps from assembly existing along the pivot axis between the pivot pin and the sleeve when the cover is mounted on the base;
- the at least one elastic tab comprises an indexing stop to indicate the position of the cover in at least one position selected from among the open position, the closed position, or an intermediate position between the open position and the closed position, the other among the base and the cover comprising a cam profile having at least one seat adapted for stabilizing the cover relative to the base in the chosen position. This indexing system formed by the elastic tab and the cam profile also assists with opening and/or closing the cap, making the cap particularly ergonomic to manipulate;
- the upper surface of the base is beveled and/or domed. In this way, at least one among the cover opening and closing movements can be assisted by the angle and/or curvature of the upper face of the base.

According to an advantageous arrangement of this second variant of the invention, the hinge device further comprises a sound generating device for indicating the arrival of the cover in at least one position selected from among the open position, the closed position, or an intermediate position between the open position and the closed position, said device being formed by at least one elastic tab provided on one among the cover and the base and adapted to pass beyond at least one rigid tab provided on the other among the cover and the base when the cover reaches the selected position relative to the base. As this sound generating device is separate from the device that closes off the dispensing orifice, there is a possibility of calibrating and adjusting the sound of the opening and/or closing of the cap independently of the means used to ensure the seal of its dispensing orifice. With such arrangements, the arrival of the cover in the closed position may be indicated by a different sound than the sound indicating its arrival in the open position, for example by sizing the associated tabs differently.

BRIEF DESCRIPTION OF THE DRAWINGS

Other features and advantages of the invention will become apparent from the following description of one of its embodiments, given by way of non-limiting example, with reference to the accompanying drawings.

In the drawings.

DETAILED DESCRIPTION OF THE DISCLOSURE

In the different figures, the same references denote identical or similar elements.

Figure 1:
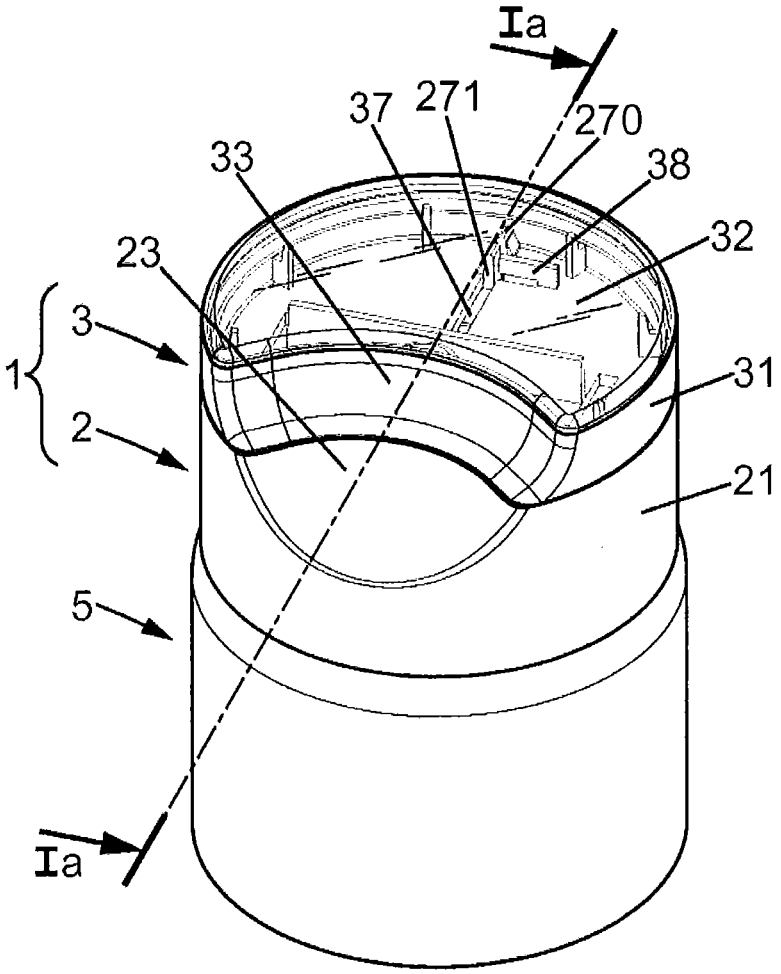
FIG. 1 is a perspective view of a first embodiment of the cap according to the first variant of the invention, with the cover in the closed position relative to the base.

FIG. 1 illustrates a first embodiment of the closure cap for a container according to a first variant of the invention.

In the various embodiments illustrated, and as visible on this FIG. 1, the closure cap 1 comprises a base 2 intended to be attached at the opening of a container 6 for a more or less viscous liquid product, particularly a cosmetic product such as a liquid product for the body, face, and/or hair, and on which a cover 3 is mounted so as to be movable between a closed position and an open position. In this FIG. 1, the cover 3, represented in the closed position, is provided with a transparent removable lid 32, on the back side of which it is possible to place a label 320 visible to a user through said transparent lid in order to customize and/or identify the cap. Alternatively, the lid may be opaque and have customized and/or identifying markings on its outer face.

In these embodiments, the cover 3 is sized and arranged on the base 2 so that in the closed position, as shown for example in FIG. 1, it covers substantially the entire upper surface 20 of the base, the respective side walls 21, 31 of said base and said cover being substantially flush along the major portion of the cap circumference.

The base 2 and the cover 3 of the cap 1 shown here also have indentations 23, 33 forming a substantially continuous surface when the cover 3 is in the closed position, indicating to the user an activation area where the user applies force to cause the cover 3 to move from its closed position to its open position.

In addition, the indentation 33 formed in the cover 3 provides a larger product distribution surface when the cover 3 is in the closed position on the base 2.

Figure 2:
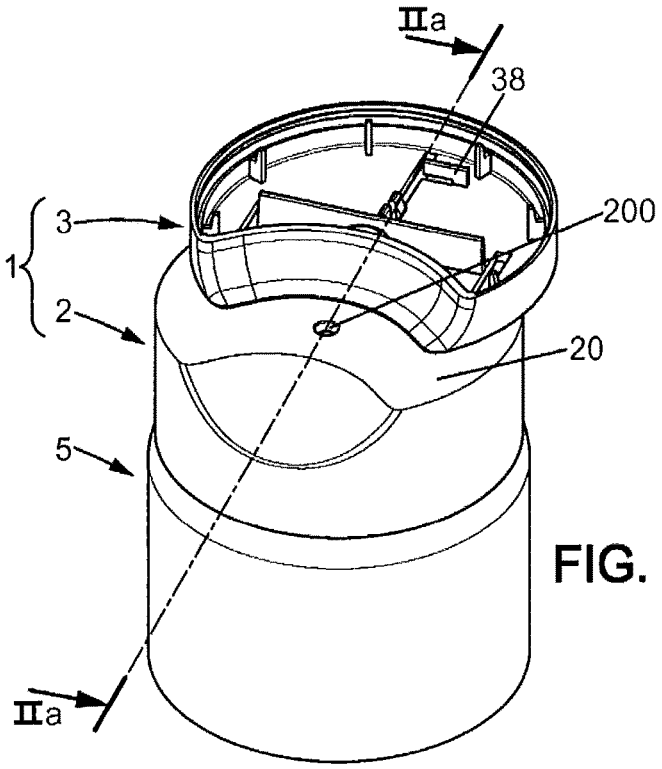
FIG. 2 is a view similar to FIG. 1, with the cover in the open position relative to the base.
Figure 2A:
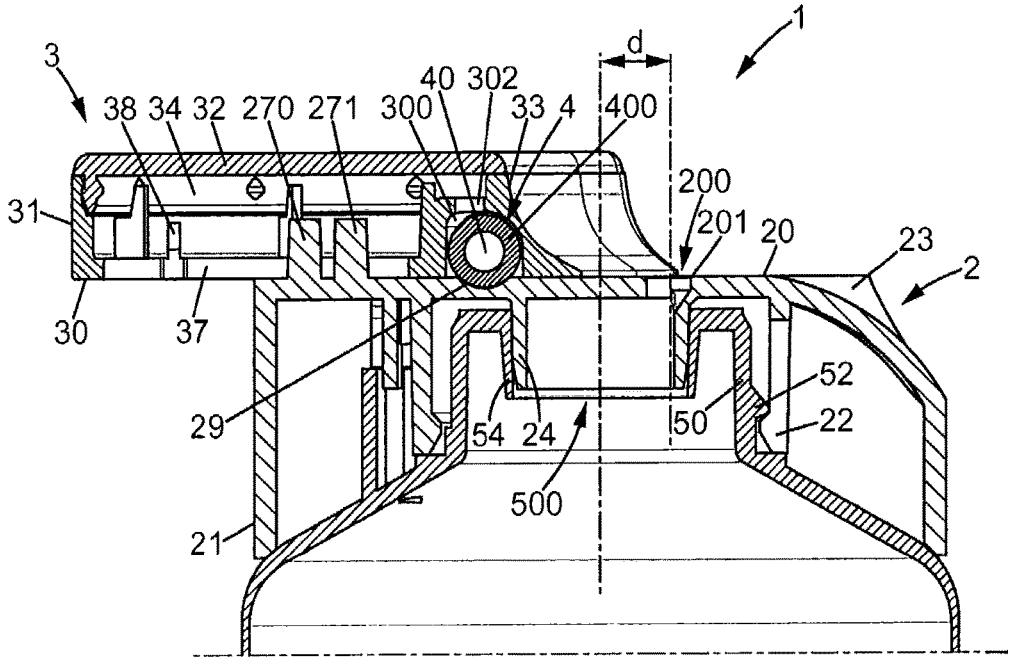
FIG. 2*a* is a cross-sectional view of the cap shown in FIG. 2 along a central plane of the cap defined by axis IIa-IIa and comprising the central axis of the base and the axis of the dispensing orifice.

FIG. 2 shows the cap according to the first embodiment of the first variant of the invention when the cover 3 is in the open position relative to the base 2, showing part of the upper surface 20 of the base 2 defining a product distribution surface having, in a substantially central area, the product dispensing orifice 200.

Figure 1A:
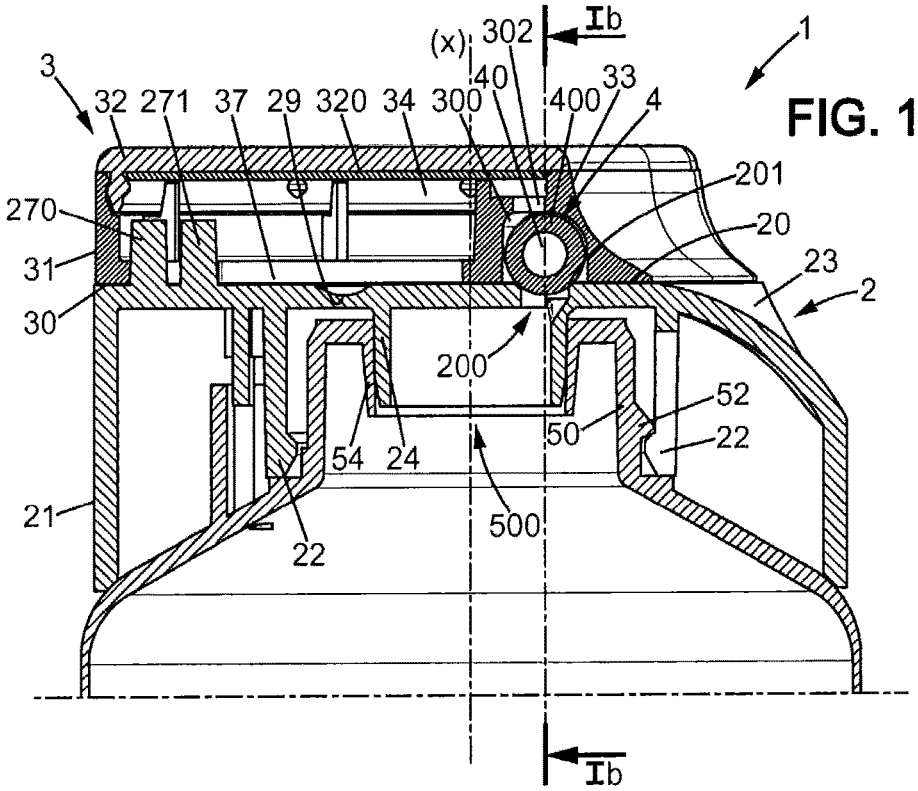
FIG. 1*a* is a cross-sectional view of the cap shown in FIG. 1 along a central plane of the cap defined by axis Ia-Ia and including the central axis of the base and the axis of the dispensing orifice.

FIG. 1*a* shows a vertical cross-sectional view along the central plane defined by axis Ia-Ia of FIG. 1. In this figure, one can see that the base 2 of the cap 1 is attached to the container 5 by clipping it onto the neck 50 via the cooperation of snap-on tabs 22 provided on the base and an annular ridge 52 formed on the neck 50 of the container 5. Alternatively, the base 2 may be attached to the neck 50 of the container 5 by any other suitable means such as a screw-on system, a bayonet attachment system, etc.

When the base 2 is secured to the container 5, a sealing skirt 24 of the base 2 is inserted into a complementary sealing skirt 54 of the container 5, and the product dispensing orifice 200 is placed in communication with the opening 500 of the container, forming a narrowing passageway for the product contained in the container 5. The base 2 further comprises an external skirt formed by the side wall 21 and designed to hide the neck 50 of the container 5.

As is particularly visible in FIG. 1*a*, the axis of the dispensing orifice 200 is offset from the central axis X of the base 2. This offset allows positioning the product dispensing orifice 200 in a substantially central area of a product holding/distribution area defined by the portion of the upper surface 20 of the base 2 that is uncovered when the cover 3 is in the open position.

With these arrangements, the user can temporarily store the dose of product that has just been extracted from the container without having to immediately transfer it to a support, which is usually the fingers in the case of a cosmetic product. This also has the advantage of allowing the user to take from this dose the amount of product that is most suitable for the intended use, for example to facilitate an intended application where small amounts are applied in successive gestures.

In the first embodiment of the first variant of the invention illustrated in FIGS. 1, 1*a*, 1*b*, 2, 2*a* and 3, the upper surface 20 of the base 2 is substantially flat and the movement of opening/closing the cap is translational along a straight line traveled by the cover 3 relative to the base 2.

Figure 1B:
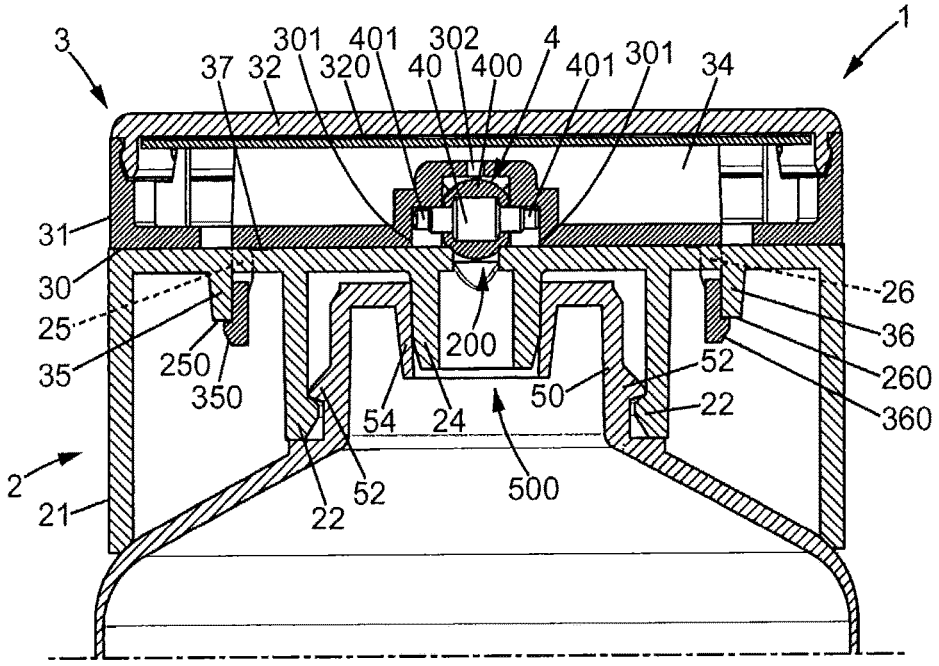
FIG. 1*b* is a cross-sectional view of the cap shown in FIG. 1 along a plane orthogonal to the cross-sectional plane of FIG. 1*a*, defined by axis Ib-Ib and comprising the axis of the dispensing orifice.

In the closed position, as illustrated in FIGS. 1, 1*a* and 1*b*, the cover 3 covers the upper surface 20 of the base 2, and the blocking device closes off the dispensing orifice 200. The blocking device is formed by a rolling element 4 arranged to rotate within a housing 300 in the cover, and which is shown here in the form of a cylindrical sleeve 40 made of a rigid material and provided with a coating of elastic material 400 so that said rolling element 4 exerts a biasing force on the upper surface 20 of the base 2.

In the particular embodiments illustrated in FIGS. 1*a*, 1*b*, 2*a*, 4, 4*a*, 4*b*, 5, 5*a*, 6, 7*a*, 8, 9*a* and 10, the housing 300 in the cover has two grooves 301 opening toward the lower surface 30 of the cover 3 and intended for receiving two diametrically opposite pins or shaft portions 401 of the rolling element 4, which are attached, for example by snapping them in place, into said grooves 301 so that the rolling element 4 is held in place and can rotate freely inside the housing 300.

As illustrated in FIGS. 13*a* to 13*d*, the rolling element 4 may be in the form of a ball 4 made entirely of elastic material and snapped into the housing 300 in the cover, or in the form of a ball or a cylindrical sleeve 40, possibly domed, made of rigid material, provided with diametrically opposite pins or shaft portions 401, and covered with a layer of elastic material 400.

Figure 13A:
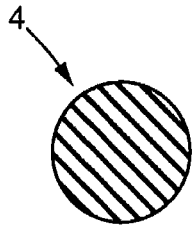
FIGS. 13*a* to 13*g* are intended to illustrate various embodiments of the rolling element which can be implemented in one or the other of the variants of the invention.
Figure 13B:
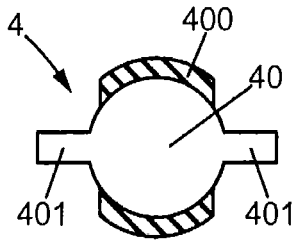
Figure 13C:
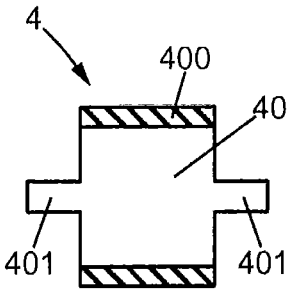
Figure 13D:
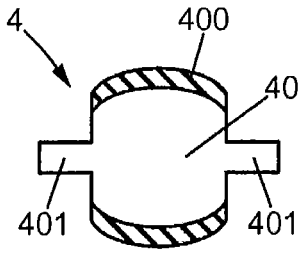
Figure 13E:
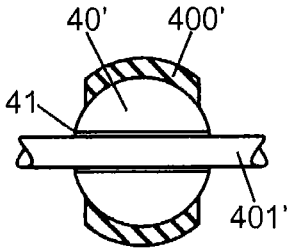
Figure 13F:
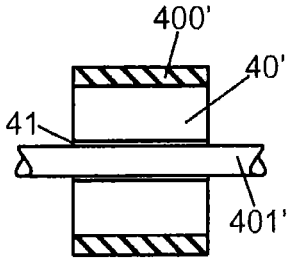
Figure 13G:
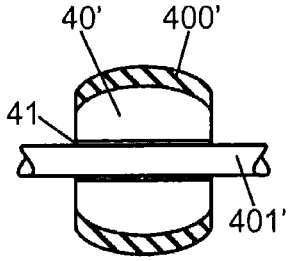

As illustrated in FIGS. 13*e* to 13*g*, the rolling element 4 could be in the form of a ball or cylindrical sleeve 40', possibly ovoid, made of a rigid material, covered with a layer of elastic material 400' and provided with a hole 41 to allow the passage of a rigid shaft 401' around which the ball or sleeve 40 is free to rotate, this shaft 401' being adapted to be received in a rotationally fixed manner inside the grooves 301 of the housing 300 in the cover 3.

In the invention, this rolling element 4 is arranged inside the housing 300 of the cover 3 so as to roll on the upper surface 20 of the base 2 when the cover 3 is moved between its open and closed positions. The element 400 of elastic material ensures that the rolling element 4 is resiliently biased in a continuous manner against the upper surface 20 of the base when the cover 3 is mounted thereon.

By varying the composition and/or the amount of biasing on the elastic element 400 when the cover 3 is mounted on the base 2, it is possible to fine-tune the sealing forces and the forces necessary to open and close the cap, and to define a compromise which both ensures that the product dispensing orifice 200 is properly sealed by the rolling element 4 when the cover 3 is in the closed position on the base 2, and provides optimal usability when the user opens/closes the cap 1.

Furthermore, when the cover 3 is in the closed position on the base 2, the rolling element 4 cooperates with a seat 201 of the dispensing orifice 200, of which the facing surface is of a complementary shape to ensure the sealing of said orifice 200. When an elastic portion is provided, the biasing it exerts increases the sealing force between said rolling element 4 and said seat 201.

As is particularly visible in FIG. 1*a*, the bottom of the housing 300 is provided with an opening 302 for discharging product from inside an inner space 34 of the cover 3, said product having possibly adhered to the outer surface of the rolling element 4 when the cover 3 is in closed position and the rolling element 4 seals the opening 200, or when the cover 3 is moved between its open and closed positions and the rolling element 4 rolls over the product distribution surface. This discharge occurs in particular when the cover 3 is moved relative to the base 2 and the rolling element 4 rolls over the upper surface of the base 20.

Also in relation to this FIG. 1*a*, the cooperation of the rolling element 4 and the dispensing orifice 200 serves to define a stable position of the cover 3 in the closed position relative to the base 2. A hollow 29, or recess, of a shape complementary to that of the rolling element 4, is formed in the upper surface of the base and is intended to cooperate with the rolling element 4 to define a stable position of the cover 3 in its open position relative to the base 2.

Referring now to FIG. 1*b*, which shows a cross-sectional view along the central plane defined by axis Ib-Ib in FIG. 1*a*, the cover 3 is guided relative to the base between its open and closed positions by means of two rails 35, 36 provided on the underside 30 of the cover 3 and equipped with snap-in tabs 350, 360, said rails 35, 36 being inserted into two complementary grooves 25, 26 formed in the upper surface 20 of the base 2, and said snap-in tabs 350, 360 cooperating with stop surfaces 250, 260 defined at the grooves 25, 26 in order to retain the cover 3 relative to the base 2 in the direction of the central axis X.

In this embodiment, the grooves 25, 26 are formed in the base 2 in its upper surface 20, and the rails 35, 36 of the cover 3 snap into said grooves 25, 26 in a direction for mounting the cover 3 on the base 2 that extends substantially parallel to the central axis X.

In FIG. 1*b*, it can be seen that the stop surfaces 250, 260 of the grooves 25, 26 of the base are provided as projections, their lateral inside surfaces guiding the movement of the rails 35, 36 within the grooves 25, 26.

In this embodiment, the path the cover 3 travels as it opens and closes relative to the base 2 is defined by the length of the grooves 25, 26 minus the length of the rails 35, 36 in the guided direction. When the cover 3 is in the closed position, the faces of the proximal ends of the rails 35, 36 in the radial direction abut against the faces of the proximal ends of the grooves 25, 26, and when the cover 3 is in the open position, the faces of the distal ends of the rails 35, 36 in the radial direction abut against the faces of the distal ends of the grooves 25, 26.

As can be seen in FIGS. 1 and 2, the guiding of the cover 3 relative to the base 2 which is performed by the guiding device can be supplemented by a device that limits the tilting of the cover 3 relative to the base 2, comprising two adjacent snap-in tabs 270, 271 oriented in opposite directions, protruding from the upper surface 20 of the base and intended to be snapped into a central groove 37 provided in the lower face 30 the cover 3. Once the cover 3 is in place on the base 2, these tabs 270, 271 press against the opposite lateral edges of the groove 37. These tabs 270, 271 are provided in a peripheral area of the upper surface 20 of the base 2 relative to the central axis X, so as to limit the tilting of the cover 3 relative to the base 2 when said cover 3 is in the open position.

Furthermore, the cap according to the invention is provided with a sound generating device to indicate that the cover 3 has reached the open and/or closed position relative to the base 2.

Figure 3:
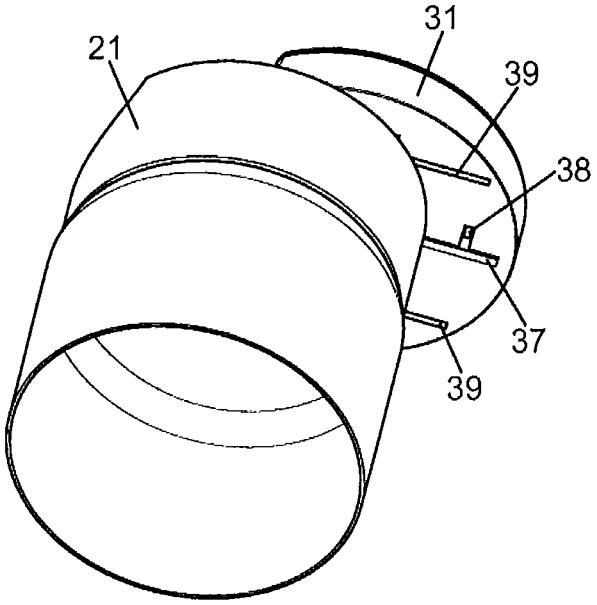
FIG. 3 is a perspective view from below of the cap according to the first embodiment, illustrating the sliding pads.

Thus, and as can be seen in particular in FIGS. 1, 2 and 3, in the first embodiment of the first variant of the invention, the closure cap is equipped with a device that generates a sound indicating that the cover 3 has reached the closed position relative to the base 2. This device is formed by a rigid tab 38 provided substantially vertically above one of the edges of the central groove 37 formed in the cover 3, and is in a peripheral position relative to the central axis X, said tab 38 being intended to cooperate with the snap-in tab 270 of the tilt-limiting device which is in contact with the same side of the groove 37, here the outermost side in the radial direction. Thus, when the cover 3 moves from its open position shown in FIG. 2, to its closed position shown in FIG. 1, the outer snap-in tab 270 comes into contact with tab 38, bending to move beyond said tab 38, and makes a sound when it relaxes and is once again in contact with the edge of the groove 37 on which it was resting, thus indicating that the cover 3 has reached its closed position relative to the base 2.

Referring to FIG. 3, the cover 3 can be equipped with sliding pads 39 for sliding on the upper surface 20 of the base 2 when the cover 3 is moved between its open and closed positions. The use of such pads 39 defines a main contact between the cover 3 and the base 2, provided by the rolling element 4 moving over the upper surface 20 of the base 2, and by these pads 39 sliding over said surface 20. Thus, when the rolling element 4 moves over the upper surface 20 of the base 2, the contact surface only offers a weak resistance in the opening/closing direction of the cap, and therefore the position and/or sizing of these pads 39 can be adjusted to control the friction forces that arise when the cover 3 is moved relative to the base 2, providing precise adjustment of the force necessary for such movement.

In a particularly advantageous manner, by adjusting the sizing and positioning of the system for guiding the cover 3 relative to the base 2, the path for opening/closing the cap can be chosen such that the elements likely to come in contact with the product via the dispensing orifice 200 or with the residue remaining on the product distribution surface, namely the underside of the cover 31 and the outer surface of the rolling element 4, are more or less entirely facing the upper face 20 of the base 2 and are not exposed and visible to the user when the cover 3 is in the open position.

More specifically, and as is particularly visible in FIG. 3, when the cover is in the open position, the rolling element 4 is not visible from the outside, and the portion of the lower surface 31 of the cover 3 overlapping the corresponding product storage/distribution area when said cover 3 is in the closed position is almost invisible to a user, except for small "corner" areas located on both sides of the sliding pads 39.

In a second embodiment of the first variant of the invention illustrated in FIGS. 4, 4*a*, 4*b*, 5, 5*a*, and 6, the upper surface 20 of the base 2 is domed and the movement of opening/closing the cap occurs as a translational movement along a curved path of the cover 3 relative to the base 2.

Advantageously, the curvature of the upper face 20 of the base 2 assists with the opening the cover.

Figure 4:
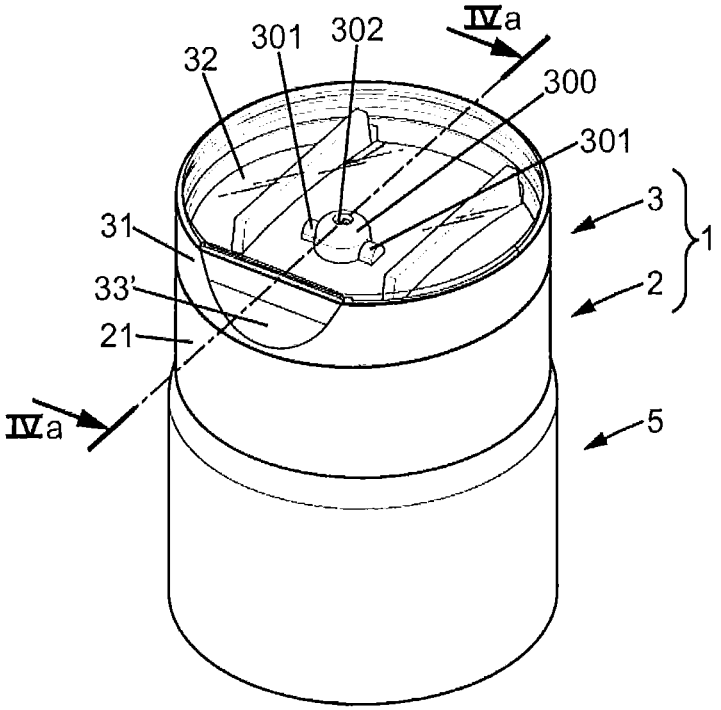
FIG. 4 is a perspective view of a second embodiment of the cap according to the first variant of the invention, with the cover in the closed position relative to the base.
Figure 4A:
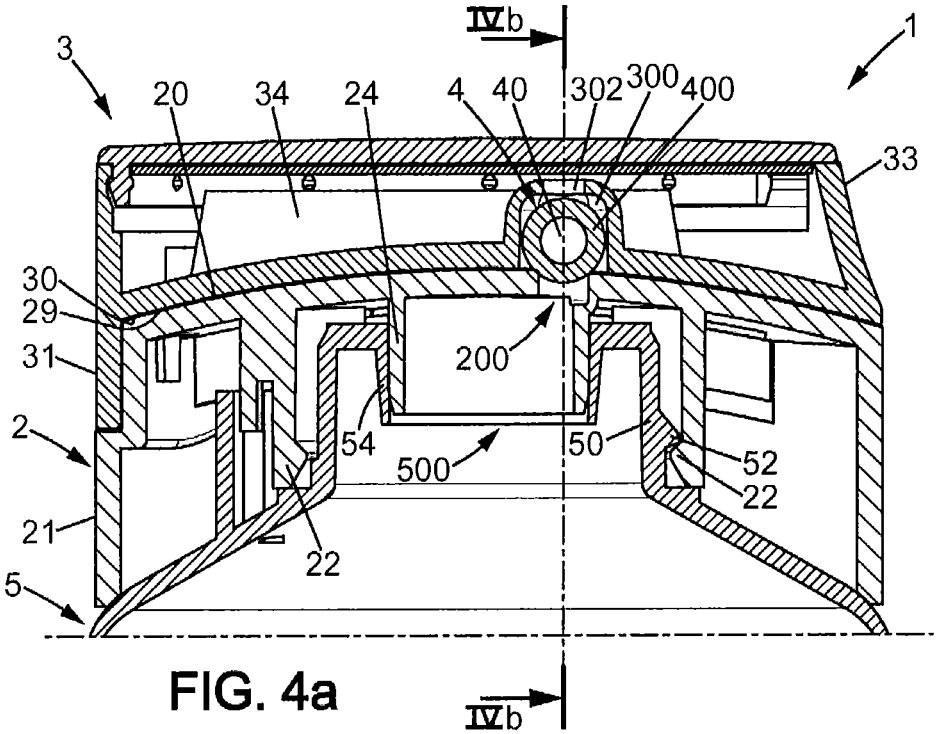
FIG. 4*a* is a cross-sectional view of the cap shown in FIG. 4 along a central plane of the cap defined by axis IVa-IVa and including the central axis of the base and the axis of the dispensing orifice.

Again, in this embodiment, when the cover 3 is in the closed position on the base 2, the cover 3 is dimensioned and arranged on the base 2 so that in the closed position, as shown in FIG. 4, it covers substantially the entire upper surface of the base 20, the side walls 21, 31 of said cover and of said base being substantially flush along the major portion of the cap circumference.

An indentation 33' is provided on the side surface 31 of the cover 3 to indicate the area of interaction for the user to open the cap 1.

Figure 4B:
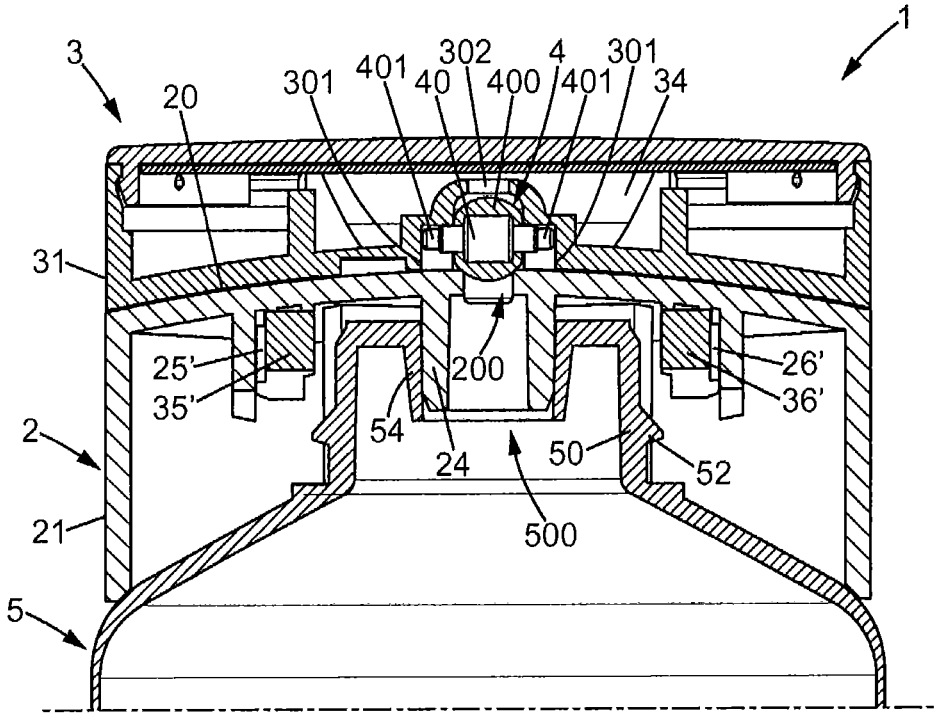
FIG. 4*b* is a cross-sectional view of the cap shown in FIG. 4 along a plane orthogonal to the cross-sectional plane of FIG. 4*a* defined by axis IVb-IVb and comprising the axis of the dispensing orifice.
Figure 5:
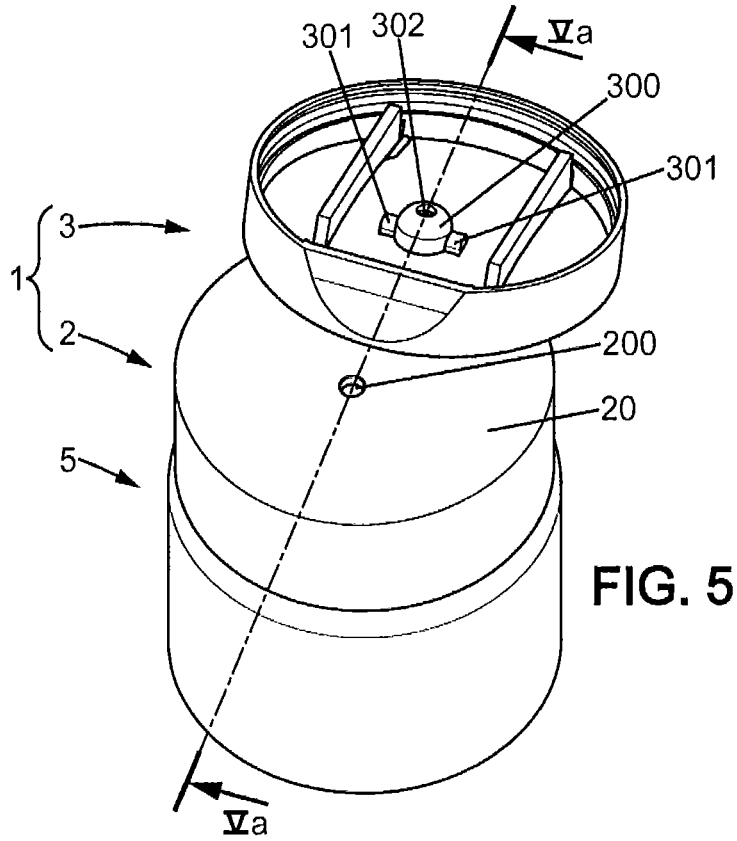
FIG. 5 is a view similar to FIG. 4 with the cover in the open position relative to the base.
Figure 5A:
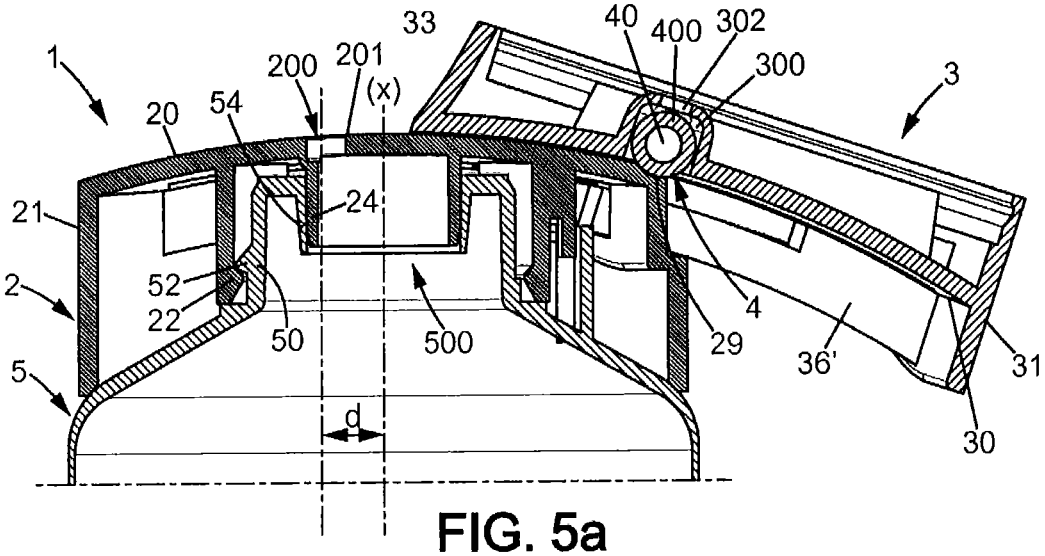
FIG. 5*a* is a cross-sectional view of the cap shown in FIG. 5*a* along a central plane of the cap defined by axis Va-Va and including the central axis of the base and the axis of the dispensing orifice.
Figure 6:
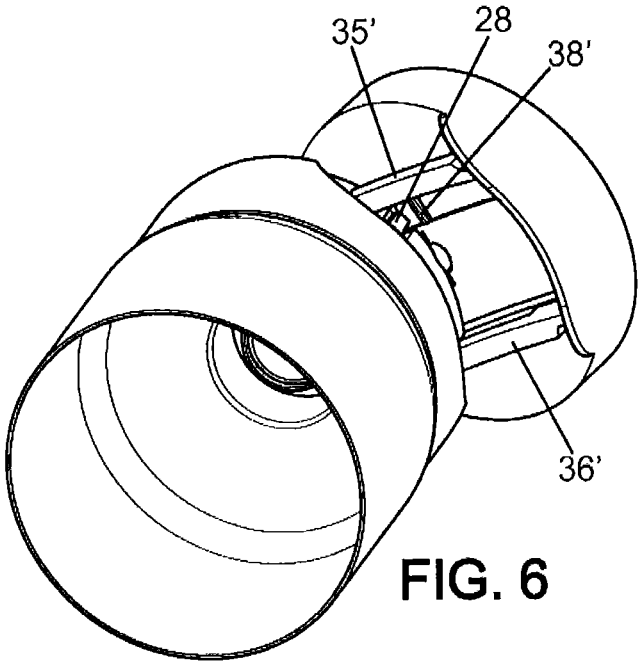
FIG. 6 is a perspective view from below of the cap according to the second embodiment, illustrating the sliding pads and the sound generating device.
Figure 6A:
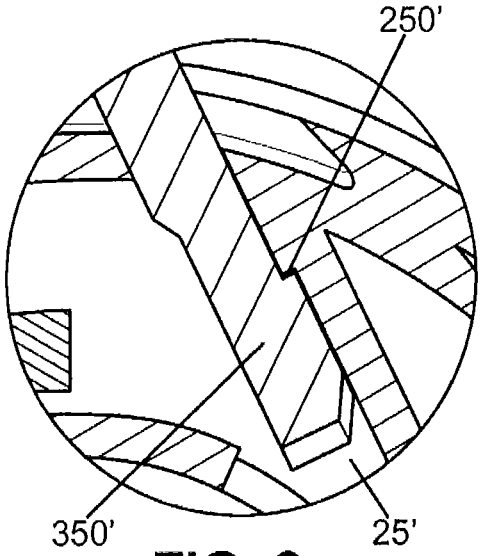
FIG. 6*a* is a cross-sectional detail view of FIG. 6, illustrating the cooperation of the snap-in tabs of the rails with the stop surfaces of the grooves in order to retain said rails within said grooves in the guiding direction when the cover is in the open position.

In this embodiment, and as shown in particular in FIGS. 4*b*, 6*a* and 6, the rail system that guides the cover 3 relative to the base in its opening and closing movements consists of two rails 35', 36' provided with snap-on tabs 350', 360' that are inserted along the guiding direction into two complementary grooves 25', 26' formed in the base, the stop surfaces of these snap-on tabs 350', 360' abutting against the stop surfaces 250', 260' provided at the grooves 25', 26' when the cover 3 reaches its open position relative to the base 2.

Referring to FIG. 6, the sound generating device used in this embodiment to indicate that the cover 3 has reached the open and/or closed position is formed of an elastic tab 28 arranged in a peripheral area 2 of the base 2 and intended to cooperate with two rigid tabs 38' protruding from the lower surface 31 of the cover 3 in order to generate, when it is forced across said rigid tabs 38', a sound indicating that the cover 3 has reached its closed position relative to the base 2, and that the cover 3 has reached its open position relative to the base 2.

A second variant of the cap according to the invention will now be described in relation to FIGS. 7, 7*a*, 8, 9, 9*a*, 10, 11 and 12. In this description, only the elements differing from the first variant will be detailed.

In the example embodiment of this second variant of the invention illustrated here, the base 2 and the cover 3 of the cap 1 respectively have an indentation 23" and a tongue 33" forming a substantially continuous surface when the cover 3 is in the closed position, and indicating to a user the area of activation where she is to exert force in order to move the cover 3 from its closed position to its open position.

Figure 7:
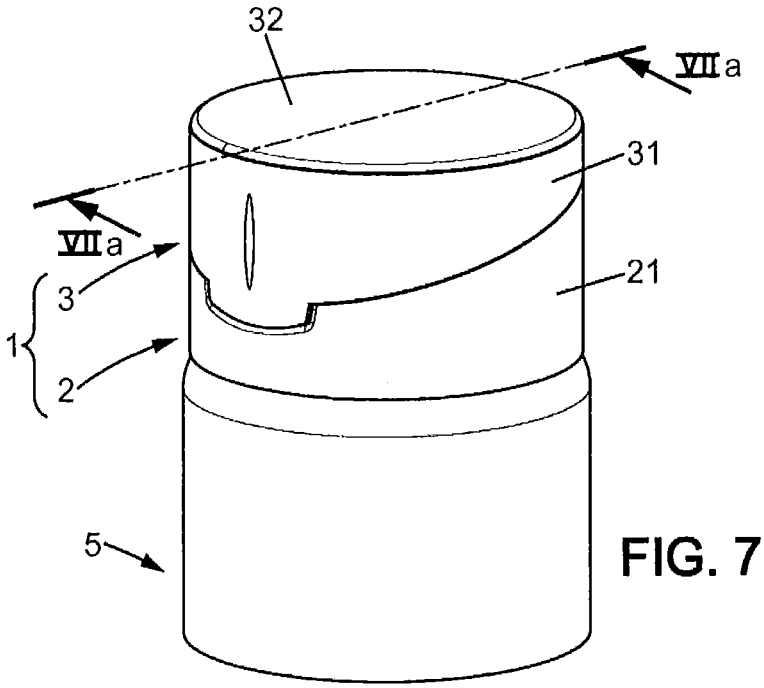
FIG. 7 is a perspective view of the cap according to the second variant of the invention, with the cover in the closed position relative to the base.
Figure 7A:
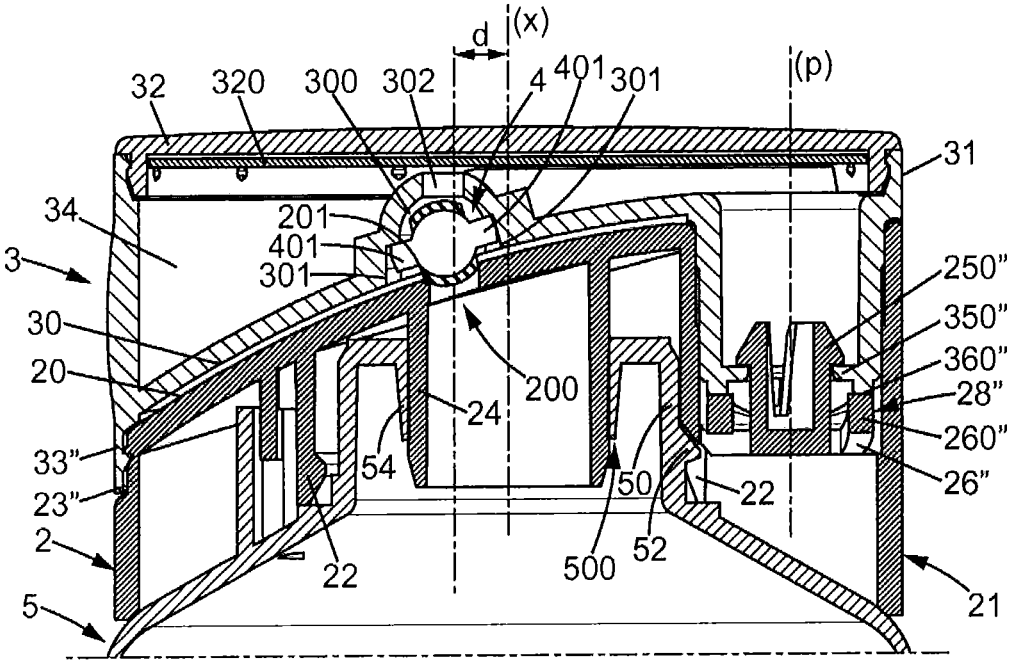
FIG. 7*a* is a cross-sectional view of the cap shown in FIG. 7 along a central plane of the cap defined by axis VIIa-VIIa and including the central axis of the base and the axis of the dispensing orifice.

FIG. 7*a* shows a vertical cross-sectional view along axis VIIa-VIIa of FIG. 7. In this figure, one can see that the base 2 of the cap according to this second variant is fixed to the neck 50 of the container 5 in a manner similar to that described for the first variant.

Also visible in FIG. 7*a* is the fact that the axis of the dispensing orifice 200 is offset from the central axis X of the base 2.

Furthermore, in the illustrated embodiment of the second variant of the invention, the upper surface 20 of the base 2 is beveled, that is to say that the normal to the upper surface 20 forms a non-zero angle with the central axis of the base 2. Furthermore, the upper surface 20 of the base is domed.

Advantageously, and as is the case in the illustrated embodiment, the slope and curvature of the upper surface of the base assists with the closing of the cap.

Figure 9:
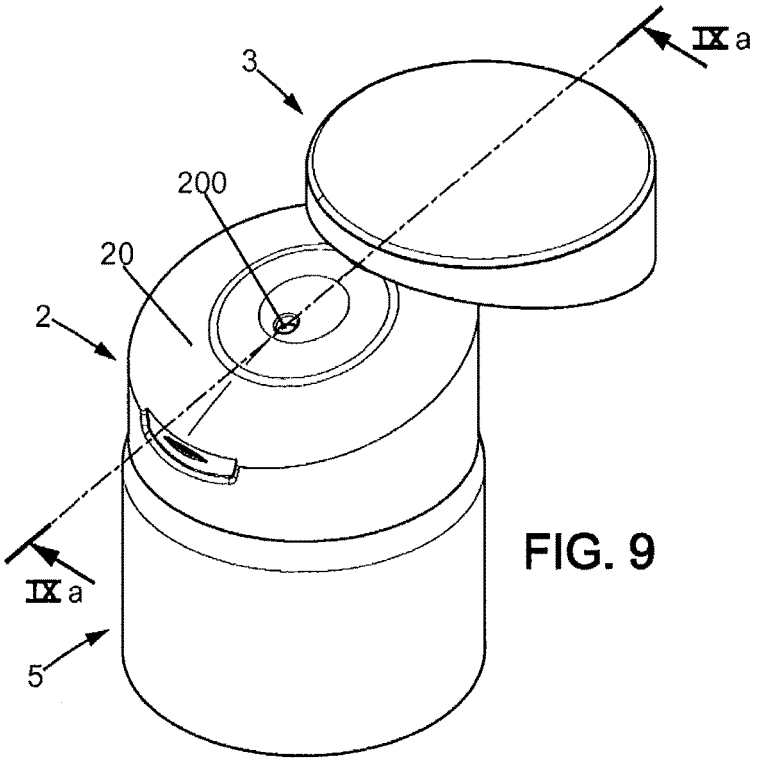
FIG. 9 is a view similar to FIG. 7, with the cover in the open position relative to the base.

In the illustrated embodiment of the second variant of the invention, the cover 3 is rotatable about a pivot axis P relative to the base 2, between a closed position illustrated for example in FIG. 7, and a closed position illustrated for example in FIG. 9, these extreme positions being angularly separated by an angle of 180°.

Figure 8:
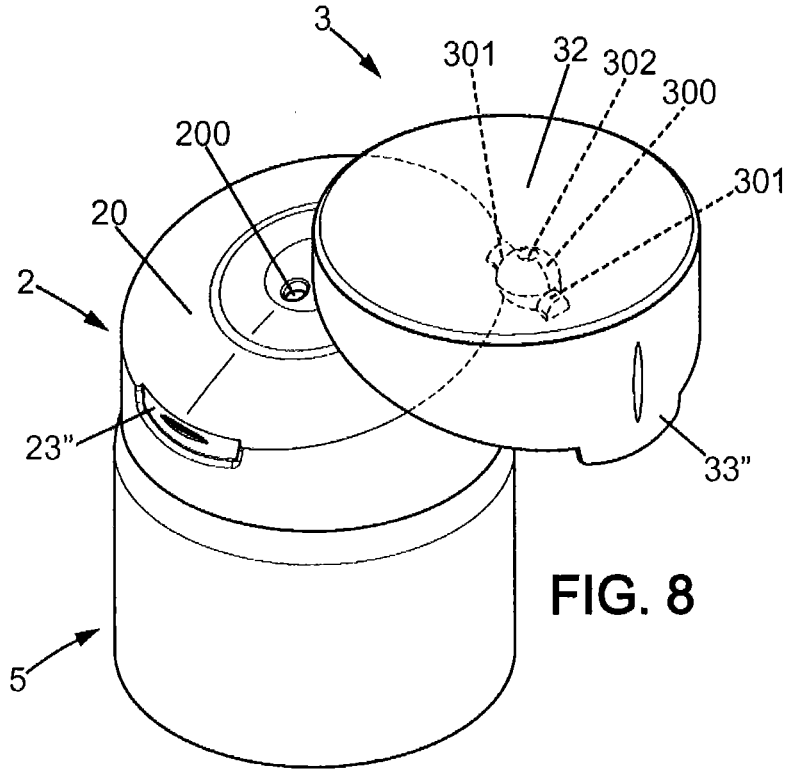
FIG. 8 is a view similar to FIG. 7, with the cover in an intermediate position relative to the base.
Figure 10:
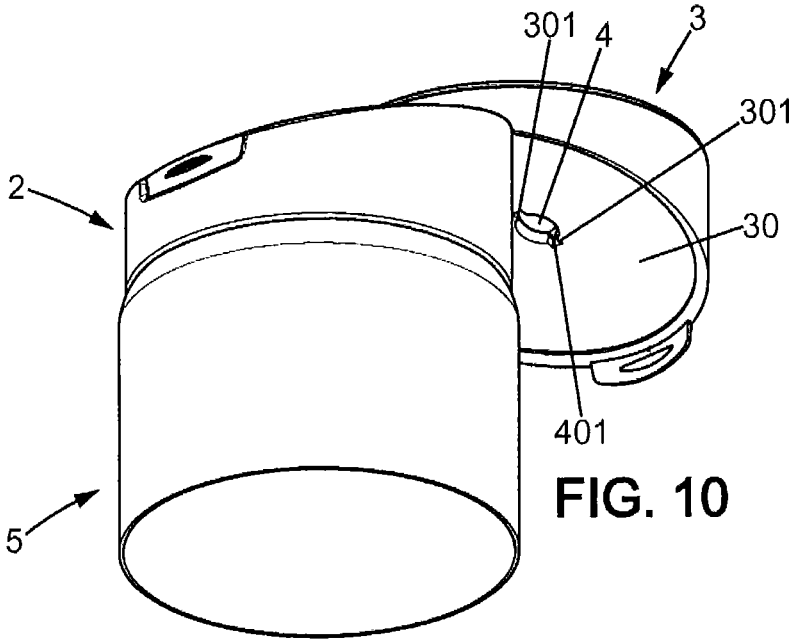
FIG. 10 is a perspective view from below of the cap according to the second variant of the invention, illustrating the rolling element.

Thus, with reference to FIGS. 7 to 9, when the cover 3 is moved relative to the base from its closed position shown in FIG. 7 to its closed position shown in FIG. 9, the rolling element 4 rolls on the upper surface 20 of the base 2 until it reaches an edge of the upper surface 20 as shown in FIG. 8. When the motion of opening the cover 3 is continued, the rolling element 4 is no longer in contact with the upper surface 20 of the base 2 and is retained within the housing 300 of the cover 3 by any appropriate means (here by means of pegs 401 snapped into grooves 301).

Alternatively, the open and closed positions of the cover 3 relative to the base 2 can be separated by an angle of less than 180° about the pivot axis P. These positions could be defined so that the rolling element 4 remains in contact with the upper surface 20 of the base 2 for the entire path traveled by the cover between its open and closed positions.

Generally, the angular distance about the pivot axis P between the open and closed positions of the cover 3 relative to the base 2 must be sufficient for the cover 3, in the open position, to uncover the product dispensing orifice 200 of the base so as to allow said product to flow through said orifice 200.

The elastic element 400 here allows the rolling element 4 to be resiliently biased against the upper surface 20 of the base when it is in contact with it.

The operation of the hinge device which mounts the cover 3 on the pivot axis P to allow it to rotate relative to the base 2 in this second variant will now be described in relation to FIGS. 7*a*, 9*a*, 11 and 12.

As can be seen for example in FIG. 7*a*, the upper surface 20 of the base 2 has a cavity 28" which opens onto said upper surface 20, the bottom of which is provided with a pivot pin 25" defining the pivot axis P of the cover 3 relative to the base 2 and intended to cooperate with a sleeve 35" protruding from the lower surface 30 of said cover 3 in order to guide the rotational opening movement of the cap 1.

When the cover 3 is in place on the base 2, the sleeve 35", integral with the cover 3, is inserted into the cavity 28" of the base 2 until the snap-in tabs 250" provided at the free end of the pivot pin 25" integral with the base cooperate by snapping onto the edge of an annular collar 350" formed in the sleeve 35" for retaining said cover 3 relative to said base 2.

Advantageously, the hinge device comprises at least one elastic tab 26", here two diametrically opposite elastic tabs, integral with the base 2 and adapted to exert a biasing force on the cover 3 along the pivot axis P when the cover is mounted on the base 2. Such an arrangement eliminates any gaps from assembly existing along the pivot axis P between the pivot pin 25" and the sleeve 35" when the cover 3 is mounted on the base 2.

Figure 11:
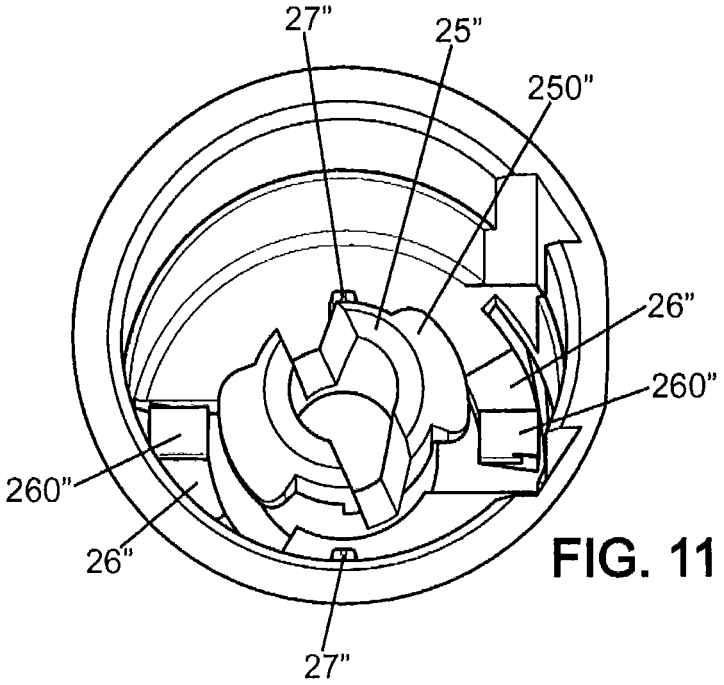
FIG. 11 is a perspective view to illustrate the elements of the hinge device provided on the base of the cap according to the second variant of the invention.

As can be seen in particular in FIG. 11, the elastic tabs 26" are formed in the bottom of the cavity 28" of the base 2 and extend along a certain angular area in the circumferential direction of the cavity 28", distanced from the bottom of said cavity 28" in the direction of the pivot axis P.

In addition, besides their gap elimination function, the elastic tabs 26" are designed to cooperate with a cam profile 36" provided at the free end of the sleeve 35" in order to assist with the opening and closing movements of the cap and to define stable positions of the cover 3 relative to the base 2. Thus, in the embodiment illustrated for example in FIGS. 11 and 12, the two tabs 26" each have at their free end an indexing stop 260" adapted to cooperate with two diametrically opposite seats 360" formed on the cam profile 36" in order to stabilize the cover 3 relative to the base 2 in its open and closed positions.

As a variant, it could be arranged so that the sleeve has only one seat 360" intended to cooperate with the indexing stop 260" of a single elastic tab 26" in order to stabilize the cover 3 in the open position relative to the base 2, the stabilization in the closed position of the cover relative to the base 2 being ensured by the cooperation of the rolling element 4 provided in the cover 3 and the seat 201 provided at the product dispensing orifice 200.

Alternatively, it could be arranged so that the sleeve 35" has a plurality of seats 360" intended to cooperate with one or more elastic tabs 26" in order to define a plurality of stable positions of the cover 3 relative to the base 2.

Thus, in the configuration illustrated in FIG. 7 or 7*a*, the cover 3 is in the closed position relative to the base 2 and the indexing stops 260" of the elastic tabs 26" provided at the bottom of the cavity 28" of the base 2 cooperate with the seats 360" of the cam profile 36" formed at the axial end of the sleeve 35" of the cover 3. As mentioned above, in this position the elastic tabs 26" may already be resiliently biased along the pivot axis P, here by bending, so that they exert a force to compensate for any existing gap between the snap-in tabs 250" of the pivot pin 25" and the annular collar 350" of the sleeve 35".

Based on this configuration, when the cover 3 is pivoted about the pivot axis P relative to the base 2 by a user, the indexing stops 260" leave their respective seats 360" and slide over the cam profile 36" of the sleeve 35", gradually causing additional bending in the elastic tabs 26" until the respective vertices 361" of the cam profile 36" are reached.

When the opening movement of the cap is continued, the indexing stops 260" cross beyond the vertices 361" of the cam profile 36" and slide on it, causing the progressive relaxation of the elastic tabs 26" until they again cooperate with the seats 360" of the cam profile 36" and stabilize the cover 3 in the open position relative to the base 2.

Figure 9A:
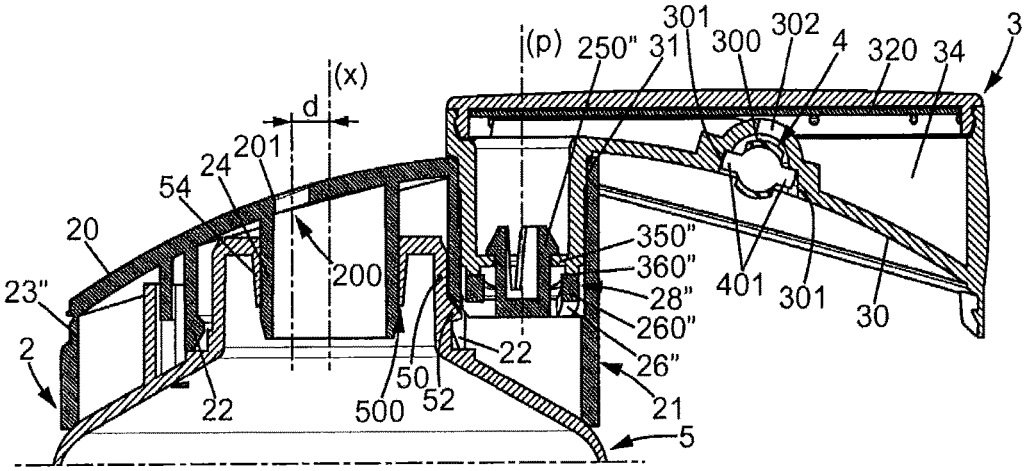
FIG. 9*a* is a cross-sectional view of the cap shown in FIG. 9 along a central plane of the cap defined by axis IXa-IXa and including the central axis of the base and the axis of the dispensing orifice.

In this position, illustrated for example in FIG. 9*a*, the indexing stops 260" of the elastic tabs 26" cooperate with the seat 360" diametrically opposite to the seat with which they cooperate when the cover 3 is in the closed position relative to the base 2.

Such a hinge device is therefore used to define stable positions for the cover 3 relative to the base when the indexing stops 260" of the flexible tabs 26" cooperate with the seats 360" of the cam profile 36", the bending of said elastic tabs 26" when the indexing stops 260" traverse the cam profile 36" generating resistance to the rotation of the cover 3 relative to the base 2. This reduces the risk of inadvertent or accidental opening of the cap when the cover 3 is in the closed position relative to the base 2. In addition, such an arrangement keeps the cover 3 stable when it is in the open position relative to the base 2, thus allowing distribution of the product while limiting the risk of inadvertently closing the cap.

Furthermore, such a hinge device serves to assist with opening and closing the cover 3 relative to the base 2, by the relaxation of the elastic tabs 26" when the indexing stops 260" have traveled beyond the vertices 361" of the cam profile 36".

In the illustrated embodiment, the hinge device defines two stable positions of the cover 3 relative to the base 2, namely a closed position illustrated for example in FIG. 7*a*, and an open position illustrated for example in FIG. 9*a*, the two positions being angularly offset about the pivot axis P by an angle of 180°. However, without departing from the scope of the present invention, one can conceive of a hinge device that allows defining, in addition to these two stable open and closed positions, one or more intermediate positions, for example offset by 90° relative to these open and closed positions.

Furthermore, the cap according to the second variant of the invention is provided with a sound generating device for indicating that the cover 3 has reached at least one position selected from among the open position, the closed position, or an intermediate position between the open and the closed position, relative to the base 2.

Figure 12:
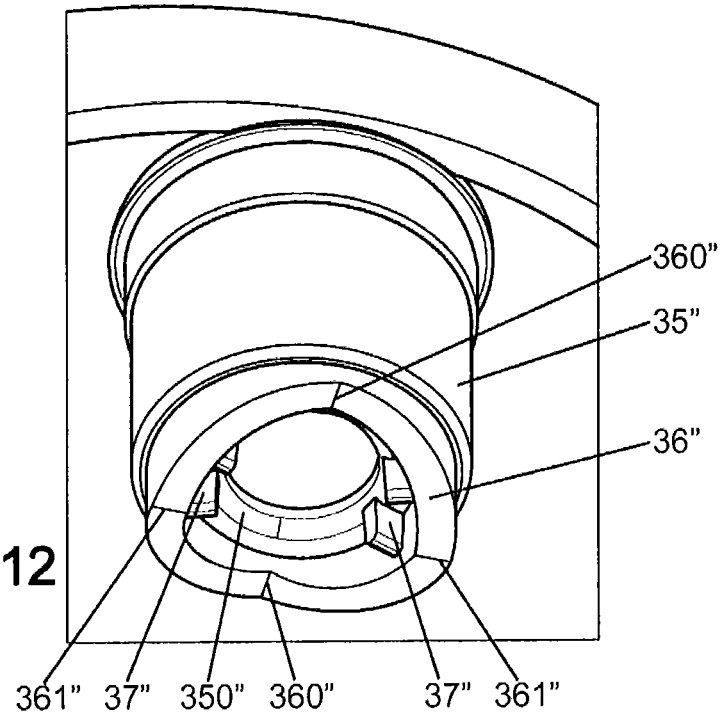
FIG. 12 is a perspective view to illustrate the elements of the hinge device provided on the cover of the cap according to the second variant of the invention.

More specifically and as is particularly visible in FIGS. 11 and 12, the hinge device that mounts the cover 3 on the base 2 comprises this sound generating device, which here is in the form of two flexible tabs 27" provided in the bottom of the cavity 28" of the base 2 and two pairs of rigid tabs 37" formed in the sleeve 35" of the cover 3. The position shown here of the different elastic and rigid tabs of the noise generating device is selected to allow indicating, signaling by sound the arrival of the cover 3 in the closed position relative to the base 2, and the arrival the cover 3 in the open position relative to the base 2. However, without departing from the scope of the present invention, one can conceive of adapting the sound generating device to indicate the arrival of the cover 3 in the various stable positions defined by the hinge device.

This sound generating device further allows indicating by sound that the cover 3 has left its open and closed positions relative to the base 2, regardless of the direction said cover 3 is pivoted relative to the base 2 about the pivot axis P. In fact, as is shown in FIG. 12, the rigid tabs 37" provided on the sleeve 35" of the cover 3 are arranged in pairs, the rigid tabs 37" of each pair of tabs being spaced apart in order to accommodate the flexible tabs 27" provided at the bottom of the cavity 28" of the base 2 when the cover 3 is in the open position relative to the base 2 and when the cover 3 is in the closed position relative to the base 2. Thus, starting from the configuration shown in FIG. 7*a*, where the cover 3 is shown in the closed position relative to the base 2 and the flexible tabs 27" of the base 2 are housed between the respective pairs of rigid tabs 37" of the sleeve 35", when the cover 3 is pivoted relative to the base 2 by rotation about the pivot axis P, said flexible tabs 27" leave the housings formed by the respective pairs of rigid tabs 37" by moving beyond one or the other of the rigid tabs 37" of each pair of rigid tabs 37" depending on the pivot direction, thereby emitting a sound indicating that the cover has left its closed position.

When this pivoting movement of the cover 3 about the pivot axis P is continued, and said cover 3 reaches its open position relative to the base 2, one of the rigid tabs 37" of each of the pairs of rigid tabs 37" of the sleeve comes into contact with a respective flexible tab 27" of the base 2 and moves beyond it which generates a sound indicating that the cover 3 has reached its open position relative to the base 2, the flexible tabs 27" of the base 2 then being received between the respective pairs of rigid tabs 37" of the sleeve 35" of the cover 3.

The invention claimed is:

1. A closure cap for a container for a viscous liquid product, comprising:

a base defining a central axis, adapted for attachment at an opening of a container and having an upper surface provided with a product dispensing orifice for dispensing said product from the container;

a cover comprising a blocking device for closing off said dispensing orifice, and movable relative to the base between a closed position where said blocking device closes off the dispensing orifice and an open position where said blocking device frees said dispensing orifice to allow the product contained in the container to emerge, said cover having a certain thickness parallel to said central axis;

wherein said blocking device comprises a rolling element and said cover comprises a housing receiving said rolling element, said housing having a top wall covering the rolling element opposite said upper surface of the base, said rolling element being rotatably mounted in said housing, wherein the rolling element is adapted to close off the product dispensing orifice when the cover is in the closed position and to roll on the upper surface of the base when said cover is moved between its open and closed positions, wherein said top wall of the housing in the cover has a product discharge channel, said product discharge channel extending between a first orifice and a second orifice, said first orifice and second orifice being distinct, wherein said product discharge channel opens upwardly through said first orifice into an inner space defined by said thickness of said cover, and wherein said product discharge channel opens downwardly through the second orifice into the housing.

2. The cap according to claim 1, wherein the blocking device comprises an elastic element adapted so that the rolling element exerts a biasing force on the upper surface of the base.

3. The cap according to claim 2, wherein the elastic element is a coating of elastic material provided at least on the surface of the rolling element in contact with the upper surface of the base, or the rolling element made entirely of this elastic material, and/or an elastic member arranged between the bottom of the housing and the rolling element.

4. The cap according to claim 1, wherein the rolling element has the general shape of a ball or a cylinder, the dispensing orifice of the base having a seat with a surface of complementary shape that faces said element.

5. The cap according to claim 1, wherein the product dispensing orifice is off-centered relative to the central axis of the base.

6. The cap according to claim 1, wherein the cover is movable relative to the base between its open and closed positions in a substantially radial guiding direction, guiding the cover relative to the central axis of the base by means of a guiding device.

7. The cap according to claim 6, wherein the guiding device comprises a slide system extending in the guiding direction and formed by at least one rail provided on one among the cover and the base and adapted to cooperate with at least one complementary groove provided in the other among the cover and the base.

8. The cap according to claim 7, wherein the slide system comprises at least two rails protruding from a lower surface of the cover, facing the upper surface of the base and provided with snap-in tabs adapted to cooperate with stop surfaces defined in respective guide grooves provided in the base in order to retain said rails within said grooves.

9. The cap according to claim 8, wherein the snap-in tabs of the rails cooperate with stop surfaces of the grooves to retain said rails within said grooves in a direction substantially perpendicular to the guiding direction.

10. The cap according to claim 8, wherein the snap-in tabs of the rails cooperate with stop surfaces of the grooves to retain said rails within said grooves substantially along the guiding direction when the cover is in the open position relative to the base.

11. The cap according to claim 6, wherein the guiding device further comprises a device limiting the tilt of the cover relative to the base, said device comprising at least two opposite snap-in tabs projecting from one among the cover and the base and adapted to cooperate with each of the edges of a groove provided in the other among the cover and the base.

12. The cap according to claim 1, wherein it further comprises a sound generating device adapted to indicate the arrival of the cover in the closed and/or open position relative to the base, said device being formed by at least one elastic tab provided on one among the cover and the base and adapted to pass beyond at least one rigid tab provided on the other among the cover and the base when the cover reaches the closed and/or open position relative to the base.

13. The cap according to claim 1, wherein it further comprises a device for defining stable positions, adapted to stabilize the cover relative to the base when the cover is in the closed and/or open position, said device being formed by the rolling element of the cover cooperating with the product dispensing orifice of the base in order to stabilize said cover relative to said base when it is in the closed position, and cooperating with a complementary hollow provided in the upper surface of the base in order to stabilize said cover relative to said base when it is in the open position.

14. The cap according to claim 1, wherein at least one sliding pad is provided on one among the cover and the base, said pad being adapted to slide over the other among the cover and the base when said cover is moved between its open and closed positions.

15. The cap according to claim 1, wherein the cover is rotatable relative to the base, about a pivot axis that is preferably substantially parallel to the central axis of the base, by means of a hinge device.

16. The cap according to claim 15, wherein the hinge device comprises a sleeve integral with one among the base and the cover and mounted to rotate about the pivot axis on a pivot pin integral with the other among the base and the cover.

17. The cap according to claim 15, wherein the hinge device comprises at least one elastic tab integral with one among the base and the cover, said at least one elastic tab being adapted to exert a biasing force along the pivot axis on the other among the base and the cover over at least a portion of the path the cover travels between its open and closed positions.

18. The cap according to claim 17, wherein said at least one elastic tab comprises an indexing stop to indicate the position of the cover in at least one position selected from among the open position, the closed position, or an intermediate position between the open position and the closed position, the other among the base and the cover comprising a cam profile having at least one seat adapted for stabilizing the cover-relative to the base in the chosen position.

19. The cap according to claim 15, wherein the hinge device further comprises a sound generating device adapted to indicate the arrival of the cover in at least one position selected from among the open position, the closed position, or an intermediate position between the open position and the closed position, said device being formed by at least one elastic tab provided on one among the cover and the base and adapted to pass beyond at least one rigid tab provided on the other among the cover and the base when the cover reaches the selected position relative to the base.

* * * * *